US005349830A

United States Patent [19]

Keller

[11] Patent Number: 5,349,830

[45] Date of Patent: Sep. 27, 1994

[54] LOCK SYSTEM

[76] Inventor: Ernst Keller, Untere Schwandenstrasse 22, CH-8805 Richterswil, Switzerland

[21] Appl. No.: 761,933

[22] PCT Filed: Jan. 11, 1991

[86] PCT No.: PCT/CH91/00010

§ 371 Date: Sep. 17, 1991

§ 102(e) Date: Sep. 17, 1991

[87] PCT Pub. No.: WO91/10795

PCT Pub. Date: Jul. 25, 1991

[30] Foreign Application Priority Data

Jan. 17, 1990 [CH] Switzerland ..... 144/90-9

[51] Int. Cl.[5] ..... E05B 27/10

[52] U.S. Cl. ..... 70/358; 70/382; 70/406; 70/409; 70/411

[58] Field of Search ..... 70/358, 367, 368, 338, 70/371, 375, 378, 382–385, 387, 490, 493, 395, 398, 401, 411, 406–409, 337–343

[56] References Cited

U.S. PATENT DOCUMENTS

| | | | |
|---|---|---|---|
| 3,303,677 | 2/1967 | Bauer | 70/358 |
| 3,349,587 | 10/1967 | Keller | 70/358 |
| 3,473,355 | 10/1969 | Saito | 70/384 X |
| 3,777,520 | 12/1973 | Crepinsek | 70/493 X |
| 3,824,818 | 7/1974 | Neale | 70/358 |
| 4,098,104 | 7/1978 | Wolter | 70/406 |
| 4,122,694 | 10/1978 | Gretler | 70/409 X |
| 4,553,452 | 11/1985 | Keller | 70/411 X |

FOREIGN PATENT DOCUMENTS

| | | | |
|---|---|---|---|
| 258153 | 11/1967 | Austria | 70/358 |
| 3508826 | 9/1986 | Fed. Rep. of Germany | 70/395 |
| 421715 | 12/1934 | United Kingdom | 70/358 |

*Primary Examiner*—Peter M. Cuomo
*Assistant Examiner*—Suzanne L. Dino
*Attorney, Agent, or Firm*—Browdy and Neimark

[57] ABSTRACT

A lock system has lock cylinders (5) in which the rotor (9) is lodged as usual in the cylinder housing, (11) as well as lock cylinders (6) in which the rotor (10) is rotated through 180° about its longitudinal axis relative to the other rotors (9). The security keys for the lock system are flat keys and not turning keys and, in the event that these are priority keys, have two completely independent key codes. The invention also provides a further possibility for increasing the number of variations of the lock and thus for increasing its security.

7 Claims, 1 Drawing Sheet

LOCK SYSTEM

BACKGROUND OF THE INVENTION

1. Field of the Invention

The invention relates to a lock system and to a key for such a lock system.

2. Prior Art

Lock systems of this generic type are generally known. As a rule, they have a great number of hierarchically arranged flat keys, with which a correspondingly large number of lock cylinders can be actuated. The keys are flat keys of the kind known for instance from German Patent 3 021 334 of the present applicant. That patent also discloses that the number of locking actions can be increased substantially by means of bores having a plurality of control faces and corresponding tumblers. The number of locking variants can be increased by other provisions, for instance by a linear shift in the bore pattern.

OBJECTIVE OF THE INVENTION

The object of the invention is to create another way of increasing the number of locking actions of a locking system of this generic type. The intent is for this to be possible in a structurally simple way, without impairing the functional reliability.

SUMMARY OF THE INVENTION

In the locking system according to the invention, the safety keys are so-called non-reversible keys, and are immediately apparent as such, for example by the shape of the head of the key. To open a lock, the key must accordingly be introduced into the key channel in one of the two possible rotary positions. Some of the lock cylinders also have rotors, which are rotated from the other rotors by 180° about their longitudinal axis with respect to the cylinder housing. The rotors may have open or closed key channels. An essential advantage of the lock system according to the invention is that two completely different lock codes can be disposed on the same key. By lessening the rotational symmetry of the keys and the associated tumblers, the number of locking variations is thus practically doubled. This is readily compatible with other known provisions to increase the locking variations. For instance, the bores may also be stepped bores, and at the same time a linear shift in the bore patterns is also possible.

The provisions necessary for the lock cylinders are comparatively simple and do not change the basic structure of the lock cylinders. In particular, the number of tumblers in the lock cylinders need not be increased relative to comparable cylinders. Manufacture of the keys at a favorable cost is also assured.

A superordinated key is for instance equipped with two independent locking codes, while a subordinated key contains only one code. A key of the system according to the invention preferably has at least two different rows of bores, which are disposed opposite one another on the wide sides of the shaft of the key. Two different locking cylinders having the same lock code or different lock codes can thus be opened with the same key, without requiring that the key be turned.

BRIEF DESCRIPTION OF THE DRAWINGS

An exemplary embodiment of the invention is described in detail below, in conjunction with the drawings. Shown are.

DETAILED DESCRIPTION OF THE PREFERRED EMBODIMENTS

Figure 1A:
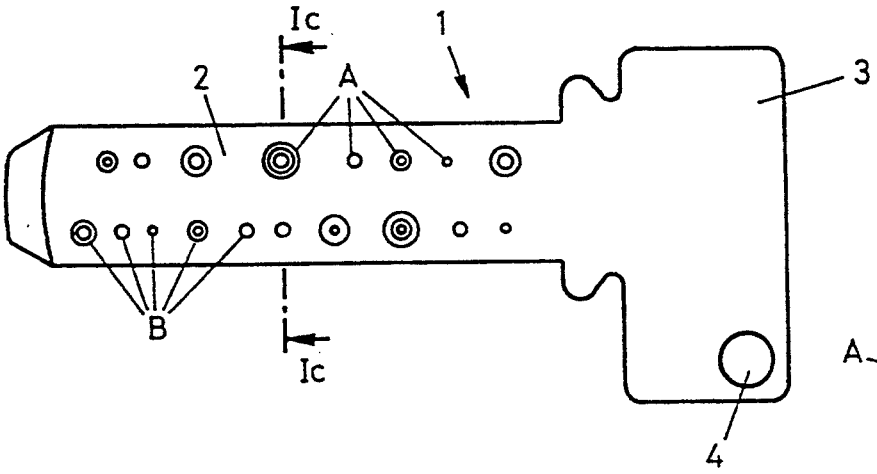
FIGS. 1*a* and 1*b*, side views of a key for the system according to the invention.
Figure 1C:
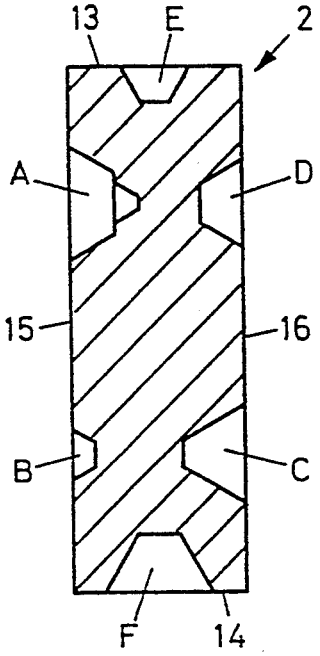
FIG. 1*c*, a cross section through a key taken along the line 1*c*—1*c* of FIG. 1*a;*
Figure 1B:
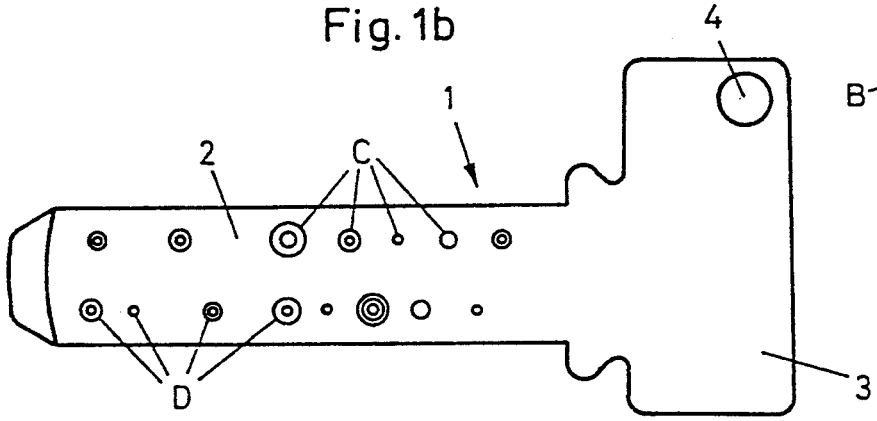

FIGS. 1*a* through 1*c* show a flat key with a shaft 2 and a key head 3. The shaft 2 has six different rows of bores a through f, each row a through f having five bores, for example. These bores are simple countersunk bores or stepped bores, which cooperate with associated tumblers in the lock cylinders.

The key has two independent lock codes, which are formed by the bore rows a, e and d or the rows b, c and f. Each group of bore rows comprises one bore row e or f, respectively, with edgewise bores on the narrow sides 13 or 14 and lateral bores on the wide side faces 15 and 16, respectively. As can be seen, the bores cannot be made to coincide by rotating the key about its longitudinal direction, as would be the case with a key intended to be turned.

The key head 3 has an asymmetrically disposed opening 4, for example, in order to make the orientation of the key 1 immediately apparent. It is understood that other markings or shapes are also possible; for instance, the key 1 may be embodied in the shape of a letter L.

Figure 2:
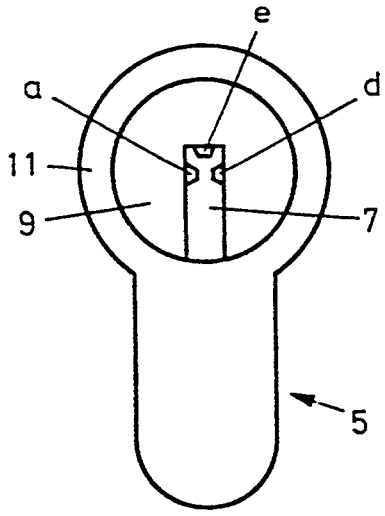
FIG. 2, a front view of a lock cylinder of the lock system according to the invention.
Figure 3:
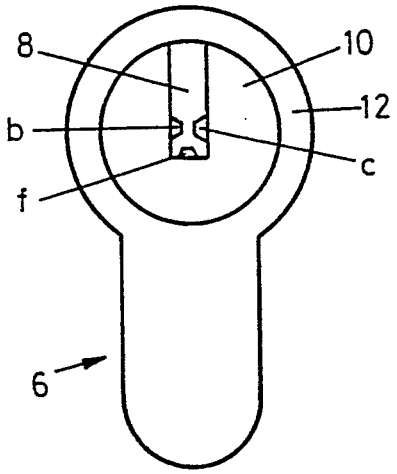
FIG. 3, a further lock cylinder of the lock system according to the invention.

In FIGS. 2 and 3, different lock cylinders 5 and 6 of a system according to the invention are schematically shown. These lock cylinders may be simple or double lock cylinders, or other special types of cylinders. Different cylinder profiles are equally possible. In the cylinder of FIG. 2, a rotor 9 in a conventional orientation is inserted into the cylinder housing 11. Core pins a, e and d protrude into a key channel 7 in the usual way. This cylinder can be entirely equivalent to a known cylinder. In the cylinder 6 of FIG. 3, a rotor 10 that is rotated about its longitudinal axis by 180° from the rotor 9 is inserted into a cylinder housing 12. The lock channel 8 of the rotor is thus laterally open at the top. Core pins b, c and f, which are likewise embodied conventionally, protrude into the key channel 8.

If the key 1 in the orientation shown in FIG. 1*a* is now introduced into the key channel 7 of the lock cylinder 5, then the tumblers are aligned with the core pins a, d and e, so that the rotor 9 can be turned and the corresponding lock can be opened. If in the same orientation the key 1 is introduced into the key channel 8 of the lock cylinder 6, then the core pins b, c and f are now aligned by the rows b, c and f, so that this rotor 10 can be turned as well.

If a key, not shown here, has merely the bore rows B, C and F, then with these subordinate keys a lock having the lock cylinder 6 can be opened, but a lock having the lock cylinder 5 cannot. The converse is true for a key, again not shown here, having the bore rows A, D and E. In one system, all the inside doors are now for instance equipped with lock cylinders 5, and all the outside doors with lock cylinder 6. By varying the bores, it will be appreciated that a great number of lock cylinders 5 and lock cylinder 6 can be manufactured, with a great many possible ways of locking. The number of locking possibilities in particular can be increased substantially by providing the lock cylinders 5 and 6 with different permutations.

A lock system in which the number of lock variations and thus the safety of locking can be increased substantially in a structurally simple way and thus economically is thus apparent from the above description.

I claim:

1. A lock system comprising;

at least one flat safety key (1), two lock cylinders (5, 6), each of which have at least one rotor (9, 10) with a key channel (7, 8) for introduction of said at least one flat safety key (1), said at least one rotor of a first lock cylinder of said two lock cylinders rotated 180° about an axis of rotation with respect to a first corresponding cylinder housing (11) of said first lock cylinder in comparison to said at least one rotor within a second corresponding cylinder housing (12) of a second lock cylinder of said two lock cylinders when said at least one rotor (9) of said first lock cylinder and said at least one rotor (10) of said second lock cylinder are respectively fixed by lock rows in said first corresponding cylinder housing and said second corresponding cylinder housing, the lock rows being aligned and the corresponding rotor turnable within the cylinder thereon when the key is introduced into the key channel, said at least one flat safety key (1) being a non-reversible key having a plurality of bores with one lock code for alignment with the lock rows of said first lock cylinder or with the lock rows of said second lock cylinder, or having a plurality of bores with two lock codes, one code for alignment with the lock rows of said first lock cylinder and the other code for alignment with the lock rows of said second lock cylinder.

2. The lock system of claim 8, wherein each of said at least one rotor have different basic codes or lock codes.

3. The lock system of claim 1, wherein a nonturning key (1) is a superordinated key, and that turning keys are also provided for the lock cylinders as subordinated keys.

4. A key for a lock system as defined by claim 1, wherein said nonturning key is recognizable as a nonturning key by an asymmetrical shaping of the key head (3).

5. The key of claim 4, wherein said nonturning key has one or two groups of rows (A, D, E; B, C, F) of bores, each row representing one key code and being disposed along one narrow side (13, 14) of the key shaft (2).

6. The key of claim 5, wherein at least one group of said two groups includes three rows of bores, wherein one row of bores of said three rows of bores is embodied by edgewise bores, and the other two rows of bores of said three rows of bores are embodied by opposed lateral bores on the wide side faces (15, 16) of the key shaft (2).

7. The key of claim 4 wherein said nonturning key is a superordinated key and has two independent key codes.

* * * * *